United States Patent [19]

Di Ciaccio

[11] 4,192,168

[45] Mar. 11, 1980

[54] GAGING SYSTEM WITH PIVOTABLE GAGE BAR

[75] Inventor: James J. Di Ciaccio, Somerville, Mass.

[73] Assignee: Dynamics Research Corporation, Wilmington, Mass.

[21] Appl. No.: 903

[22] Filed: Jan. 4, 1979

[51] Int. Cl.[2] ..... B21D 11/22

[52] U.S. Cl. ..... 72/389; 72/461

[58] Field of Search ..... 72/441, 389, 36, DIG. 21, 72/10, 21; 83/71

[56] References Cited

U.S. PATENT DOCUMENTS

| | | | |
|---|---|---|---|
| 784,726 | 3/1905 | Yates | 72/461 |
| 2,429,387 | 10/1947 | Buchheim | 72/461 |
| 3,421,359 | 1/1969 | Gibbs | 72/461 |
| 3,580,023 | 5/1971 | Merrill | 72/461 |
| 3,704,611 | 12/1972 | Hirsch | 72/36 |
| 3,820,377 | 6/1974 | Roch | 72/461 |
| 3,826,119 | 7/1974 | Marotto | 72/36 |
| 4,089,200 | 5/1978 | Wingate | 72/389 |

*Primary Examiner*—Francis S. Husar
*Assistant Examiner*—Gene P. Crosby
*Attorney, Agent, or Firm*—Weingarten, Maxham & Schurgin

[57] ABSTRACT

Gaging apparatus for a metal forming machine having a gage bar which is pivotable about a central longitudinal axis of the bar and which is maintained in a normal position by a spring mechanism. In the presence of an upward force applied to the bar, the bar will pivot upwardly, and upon removal of the upward force, will be returned by the biasing action of the spring mechanism to its rest position. A switch can be associated with the gage bar for actuation during upward movement of the bar to provide a control signal to the gage positioning system to cause withdrawal of the bar away from the metal being formed.

11 Claims, 7 Drawing Figures

GAGING SYSTEM WITH PIVOTABLE GAGE BAR

FIELD OF THE INVENTION

This invention relates to gaging systems for metal forming machines and more particularly to gaging apparatus for a press brake or similar machine.

BACKGROUND OF THE INVENTION

A gaging system is described in U.S. Pat. No. 4,089,200, assigned to the assignee of this invention, which is especially adapted for use as a back gage with a press brake for positioning metal sheet at intended locations with respect to the press brake dies for forming intended bends at the gaged locations. In the system of that patent, a gage bar is adjustably supported at an intended height with respect to the dies of the associated press brake, and is movable in response to control signals toward or away from the dies to specified gage positions and to define a gaged stop against which a metal sheet is butted in position for a bend to be made.

It is sometimes desirable, as in making return bends in a sheet, to allow pivoting of the gage bar to prevent obstruction by the bar of a sheet being bent, and to prevent damage to the bar by the formed sheet. Back gages and other similar gaging apparatus are known in which pivotable gage bars are employed. As an example, in U.S. Pat. No. 3,812,695, a back gage is described having a gage bar which is upwardly pivotable when subjected to the upward force of an obstructing metal sheet, the bar being returnable by gravity to its normal position after removal of the obstructing force. Pivotable gage stops are also shown in U.S. Pat. Nos. 784,726, 3,421,359 and 3,826,119. In the aforesaid U.S. Pat. No. 4,089,200 of the present assignee, the gage bar itself is not pivotable, but gage finger assemblies are adjustably mountable on the gage bar and which are pivotable to provide a similar function, that is, the provision of gage stops which can be upwardly pivoted to prevent obstruction with a sheet being bent.

SUMMARY OF THE INVENTION

The present invention provides gaging apparatus for a metal forming machine, such as a back gage for a press brake, having a gage bar which is pivotable about a central longitudinal axis of the bar and which is maintained in a normal or rest position by a spring mechanism. In the presence of an upward force applied to the gage bar, such as by engagement of the bar by a sheet being formed, the bar will pivot upwardly, and upon removal of the upward force, will be returned by the biasing action of the spring mechanism to its rest position. A switch can be associated with the gage bar for actuation during upward movement of the bar to provide a control signal to the gage positioning system to cause withdrawal of the bar away from the metal being formed. Thus, an obstruction or other force which causes pivotable movement of the gage bar will cause rearward movement of the bar away from the obstructing force to prevent damage to the gage apparatus and to the sheet being formed. The gage bar can be returned to its intended gage position by appropriate command, usually by operator-initiated command by means of actuation of a control button on the control panel of the gaging system.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
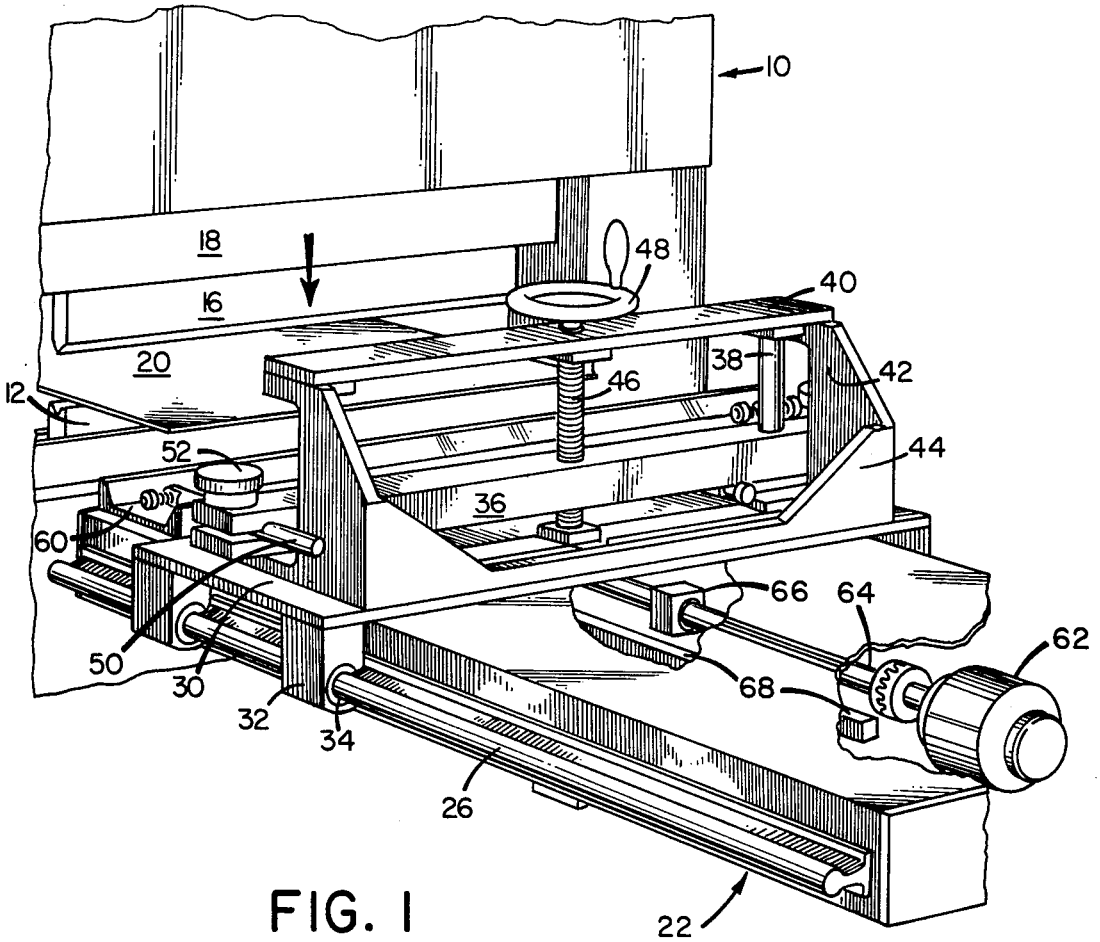
FIG. 1 is a pictorial view of a gaging system including a pivotable gage bar according to the invention.

Referring to FIG. 1, there is shown a gaging system which employs the novel pivotable gage bar, the system being mounted at the rear of a metal forming machine, here illustrated as a hydraulic press brake 10 for bending sheet metal stock. The press includes a fixed die 12 secured to a support member 14, and a movable die 16 affixed to and driven by a ram 18. A sheet 20 of metal is inserted from the front of the press 10 between the dies 12 and 16 to an intended position, the press being operative in well known manner to produce a bend in sheet 20 by coaction of the dies. The gaging system is the subject of the aforesaid U.S. Pat. No. 4,089,200 and includes a generally rectangular base 22 mounted on a suitable supporting structure and secured to the press 10. First and second guide rods 26 and 28 are mounted on respective sides of base 22 and extend substantially along the length thereof from the front to the back of the base. In usual implementation, the base and guide rods are horizontally mounted. A table 30 is supported above base 22 for horizontal movement forward and rearward along the guide rods. The table 30 is supported on the guide rods by downwardly extending corner posts 32 each having a respective ball bushing 34 for accurate low-friction sliding movement on the associated guide rods.

An arm 36 is horizontally disposed along the width of the table and is mounted for vertical movement in order to provide vertical adjustment of the gaging stop. Vertical guide rods 38 are secured by a supporting structure including top plate 40, side plates 42 and back plate 44. The arm 36 is mounted by means of suitable bushings on rods 38 for slidable movement thereon as governed by the rotation of a vertical adjustment screw 46 which is threaded into a cooperative opening through arm 36 and which is supported between lower and upper bearings. A hand wheel 48 is affixed to screw 46 for manual rotation thereof to provide vertical adjustment of the arm 36. Each end of arm 36 is slotted and drilled for clamping of support arms 50 for slidable movement therein. The knobs 52 and respective shafts are threadably attached to the respective slotted ends of arm 36 and are operative to clamp the arms 50 for course positioning of the gage bar 60.

A servo drive motor 62 is disposed within base 22 and has a shaft coupled via a flex joint to a drive shaft 64 supported for rotation at the respective ends thereof by suitable bearings. The rotational movement of the drive shaft is converted into translational movement by a linear actuator 66 such as a Roh-lix coupler through which the shaft is rotatably disposed. A linear encoder 68 is mounted within base 22 and is disposed adjacent to and along the length of the drive shaft 64. The encoder is connected to the movable table 30 by a suitable coupler and is operative to provide an electrical output representative of the position of the movable table. The servo motor is driven in response to signals from an electronic controller to position the table and the gage bar at intended gage positions. The actual position of the gage bar is monitored by the linear encoder disposed along the travel path of the table to provide control signals for closed-loop, servo control of gage position.

Figure 2:
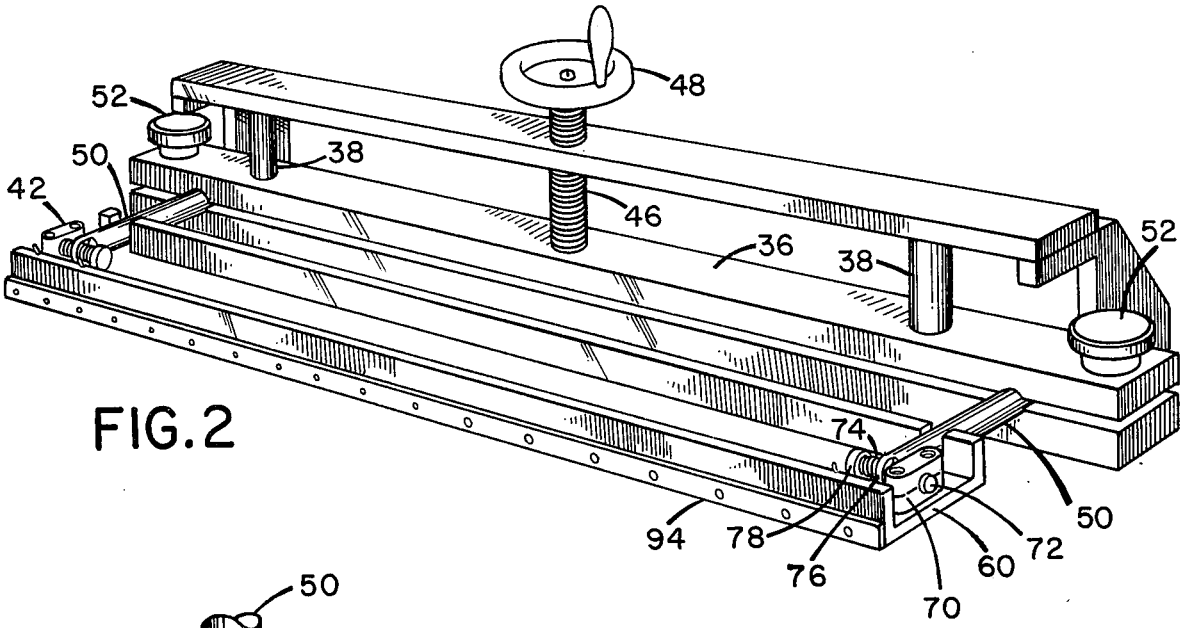
FIG. 2 is a pictorial view of the pivotal gage bar attached to the gaging system.

The pivotable gage bar is shown more particularly in FIG. 2. The bar is formed of a structural channel having a bottom wall and forward and rearward upstanding side walls. A support block 70 is affixed to the bottom wall of the channel at each end thereof, each block securing a pivot rod 72 which is aligned along the longitudinal axis of the bar 60 and about which the gage bar is balanced. Mounted on each pivot rod 72 is a torsion spring 74 and the end 76 of a respective support arm 50. A collar 78 fastened on the end of the pivot rod retains the confronting torsion spring. The spring ends are retained in any convenient manner. Typically, one end of the spring 74 is in a notch provided in the forward side wall, while the other end of the spring is supported on a pin radially extending from the support arm 50.

Figure 3:
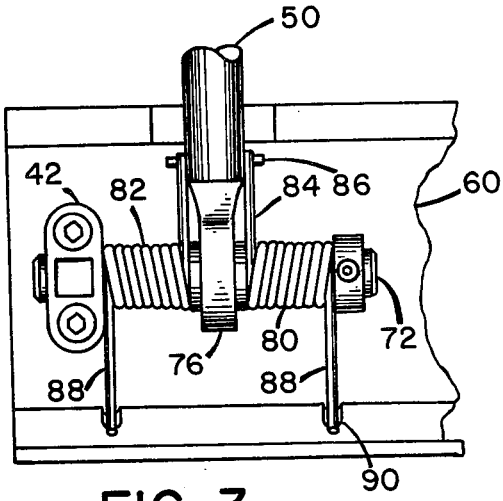
FIG. 3 is a cutaway top view of the pivotal gage bar having dual torsion springs.
Figure 4:
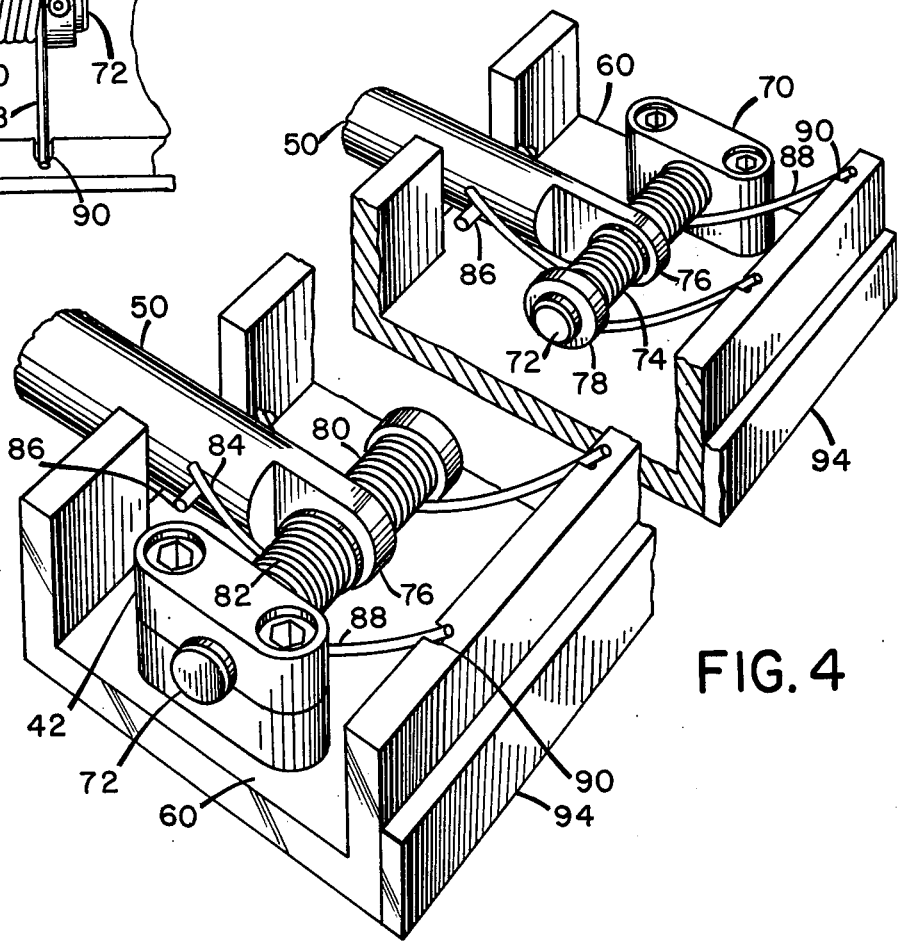
FIG. 4 is a cutaway pictorial view of a pivotable gage bar utilizing dual torsion springs.

An alternative embodiment utilizing dual torsion springs is illustrated in FIGS. 3 and 4. As illustrated, the structure is generally similar to that previously described except that two torsion springs are mounted on each pivot rod. One spring 80 is mounted on the pivot rod 72 on one side of the support arm 50, while a second torsion spring 82 is mounted on the pivot rod on an opposite side of the support arm. Each spring has an end 84 resting on a respective radially extending pin 86 attached to the support arm, and an opposite end 88 resting within a notch 90 provided in the forward side wall of the channel. Each arm end 76 includes a universal rod end bearing 92 to accommodate slight misalignment which may occur between the support arms and the gage bar.

The springs are biased to urge the bar 60 into a normally horizontal and non-tilted position, as in FIG. 2. In use, the forward wall of the gage bar is in position at a defined gage stop and is the surface against which a metal sheet is butted in position for a bend. The gaging surface may have a hardened faceplate 94 attached thereto to serve as the actual gaging surface. The bias force on the gage bar caused by the torsion springs provides a downward force to maintain the bar in its normal rest position. When a superior upward force is applied to the gage bar, as by engagement of the bar by an obstructing metal sheet, the bias force is overcome and the bar pivots upwardly about its central longitudinal axis. After removal of the upward force, the bar returns to its normal rest position by the biasing action of the springs.

The biasing force provided by the springs is determined in accordance with the particular gage bar assembly employed and the magnitude of the obstructing force which is intended to cause tilting of the bar. In the dual spring version shown in FIGS. 3 and 4, one of each pair of springs can be disconnected to reduce the biasing force. The spring can be readily decoupled from the associated apparatus by removing a spring end 84 from the associated pin 86.

Figure 5:
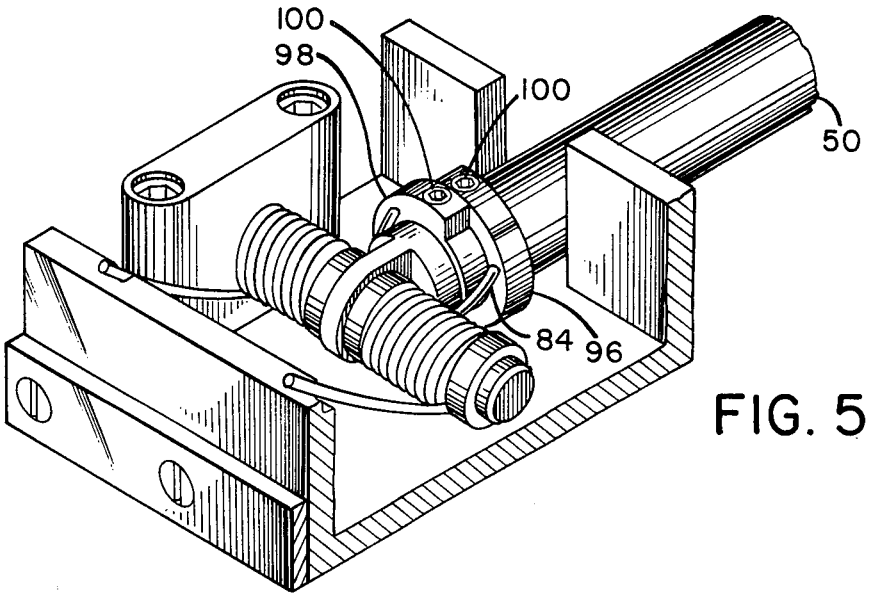
FIG. 5 is a cutaway pictorial view of an adjustable dual torsion spring biasing mechanism for the pivotable gage bar.

An embodiment of the invention is shown in FIG. 5 wherein the biasing force on the gage bar 60 is adjustable to intended degrees. The apparatus is as described above; however, in this embodiment, first and second adjustment collars 96 and 98 are provided around each support arm 50 and are slidable and rotatable thereon. The collars can be locked in position by associated set screws 100. Each collar includes an opening for retaining an end 84 of a respective torsion spring. The tension of each spring can be adjusted by movement of the associated collars 96 and 98 on the support arm 50 to raise or lower the confronting spring ends and thereby alter spring tension. The adjustment collars are moved both longitudinally and rotationally on the support arm 50 to maintain alignment of the respective spring ends during adjustment. In this embodiment, the spring tension and therefore the bias force can be easily adjusted to an intended magnitude such that the gage bar 60 will be tilted upwardly only in the presence of an applied force which exceeds the bias level. Such adjustment of bias level is often useful to accommodate the different obstructing forces which can be provided by metal sheets of different thicknesses which are being bent on the press brake with which the gaging system is employed.

Figure 6:
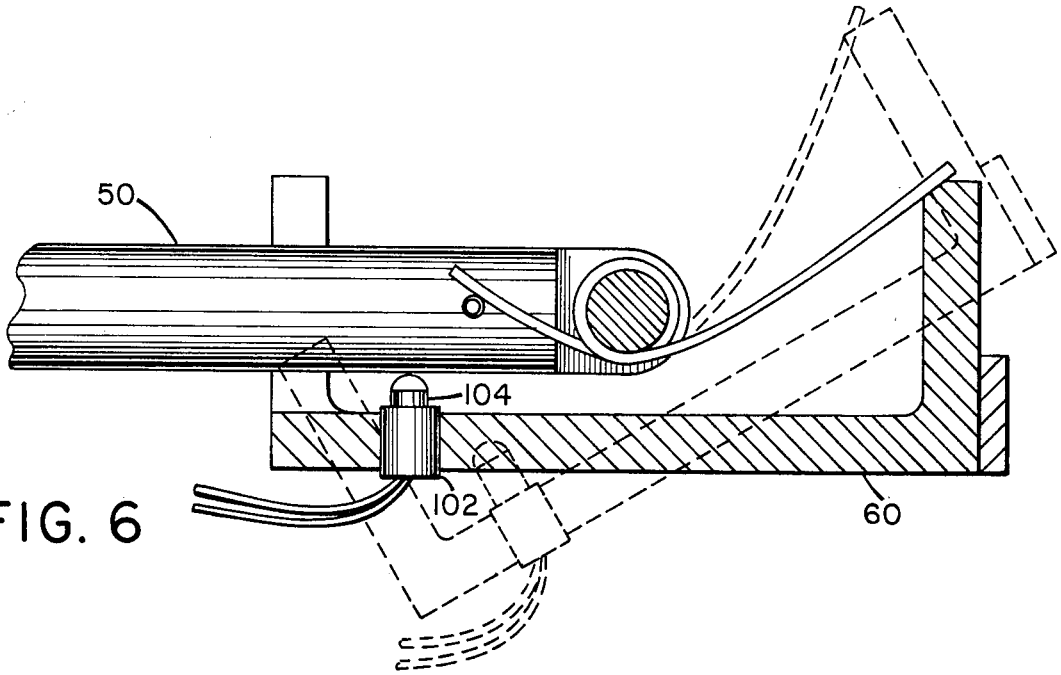
FIG. 6 is a cutaway pictorial view of the pivotal gage bar having a switch for pivot sensing.

Referring to FIG. 6, there is shown an electrical switch 102 mounted on the bottom of the gage bar 60 and having an operating button 104 in contact with the support arm which maintains the switch in one electrical state when the gage bar is in its normal rest position, as illustrated. During upward pivoting movement of the gage bar, the operating button 104 of the switch 102 is released, causing the switch to change its electrical state and provide a control signal which is employed in the gage positioning system to cause withdrawal of the gage bar away from the metal being formed. As a result, an obstruction or other force causing pivotable movement of the gage bar will cause rearward movement of the movable table and the gage bar carried on the table away from the obstructing force to prevent damage to the gage apparatus and to the sheet which is being formed. The gage bar in its tilted position is illustrated in dotted outline in FIG. 6. Usually the switch 102 will be normally off when the bar is in its rest position, and will be on when the bar is in its tilted position.

Figure 7:
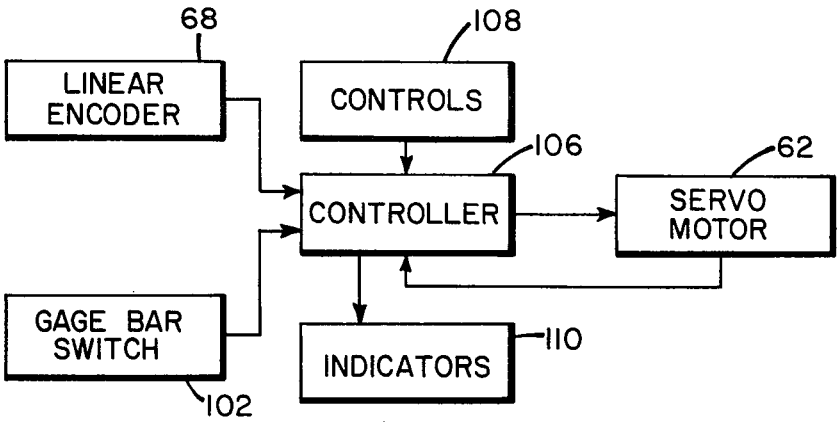
FIG. 7 is a block diagram of a control system for a gaging system employing a pivotal gage bar.

The gage bar switch is coupled to the gage positioning system as schematically shown in FIG. 7. The gage bar switch 102 is connected to a controller 106 which also receives position signals from the linear encoder 68 which is disposed along the travel path of the movable table, as described above. Various other controls 108 are coupled to the controller 106 for providing data and operating commands to the system. Indicators 110 are actuated by the controller to provide an output indication of system status and of displayed data. The controller 106 drives the servo motor 62 in a closed-loop control mode and is operative to position the gage bar 60 at positions specified by the controller. Upon actuation of the gage bar switch 102 caused by tilting of the bar, the signal provided to the controller 106 by this switch causes operation of the servo motor 62 to withdraw the table and gage bar from the gaging position. After the gage bar returns to its rest position, the table can be returned to the gage position by appropriate operator command initiated by operation of an appropriate control button. Or the table can be automatically returned to its intended position after return of the gage bar to its rest position.

The invention is not to be limited by what has been particularly shown and described except as indicated in the appended claims.

What is claimed is:

1. For use in a gaging system employed with a sheet forming machine and having a table movable along a travel path, a gage bar assembly mounted on the table, said assembly comprising:

an elongated gage bar attached to the table and having a gaging surface against which a sheet can be positioned, and a longitudinal axis about which the bar is symmetrically disposed;

support arms each attached at one end to the table and each pivotally attached at the opposite end to the gage bar;

means for pivotally attaching the gage bar to the confronting support arm ends at a pivot axis disposed at the longitudinal axis thereof; and a biasing mechanism coupling the pivotal end of each support arm and the gage bar and operative to urge the bar to a rest position in the absence of an upward force applied to the gaging surface of the bar.

2. The gage bar assembly of claim 1 including:

a support block attached to the gage bar near each end thereof;

a pivot rod mounted on each support block and disposed along the longitudinal axis of the bar and substantially orthogonal to the axis of the support arm, the gage bar being pivotable about the pivot rod;

said support arms each including a universal rod end attached to the pivot rod; and said biasing mechanism including spring means disposed around each pivot rod and urging the gage bar into its rest position.

3. The gage bar assembly of claim 1 wherein said gage bar includes:

a channel member having a bottom wall and first and second upstanding side walls, the outer surface of the first wall providing the gaging surface.

4. The gage bar assembly of claim 2 wherein said biasing mechanism includes:

at least one torsion spring disposed around each pivot rod and urging the gage bar into its rest position.

5. The gage bar assembly of claim 4 wherein said biasing mechanism includes:

one or more adjustable collars mounted around each support arm and operative to vary the bias force on said gage bar.

6. The gage bar assembly of claim 1 including:

a switch disposed on said gage bar and actuable upon pivoting of said bar to provide a control signal.

7. The gage bar assembly of claim 6 including:

means operative in response to said control signal to move the gage bar rearward away from the sheet forming machine.

8. For use in a gaging system employed with a sheet forming machine and having a table movable along a travel path toward or away from the machine, a gage bar assembly mounted on the table and movable therewith to intended gage positions, said assembly comprising:

an elongated channel shaped gage bar having a bottom wall and first and second upstanding side walls, the outer surface of the first side wall providing a gaging surface against which a sheet can be butted, the bar being pivotable and symmetrically disposed about its longitudinal axis;

first and second support blocks each attached to the bottom wall of the gage bar near respective ends thereof;

first and second pivot rods each mounted on a respective support block and aligned along the longitudinal axis of the gage bar;

first and second support arms each having an end pivotally attached to a respective pivot rod and each extending through a slot in the second side wall of the gage bar and attached to its opposite end to the movable table; and a spring mechanism disposed around each pivot rod and coupling the gage bar and the associated support arm, and operative to urge the gage bar to a rest position in the absence of an upward force applied to the gaging surface of the bar.

9. The gage bar assembly of claim 8 wherein said gage bar includes:

a protective face plate attached to the outer gaging surface of the first side wall.

10. The gage bar assembly of claim 8 wherein said spring mechanism includes:

one or more torsion springs mounted on each product, each spring having one end support on the gage bar and the other end supported by a support arm.

11. The gage bar assembly of claim 8 wherein said spring mechanism includes:

means of each support arm coupled to the respective spring mechanism and operative to adjust the bias force on said gage bar.

* * * * *